US005217089A

United States Patent [19]

Virk

[11] Patent Number: 5,217,089

[45] Date of Patent: Jun. 8, 1993

[54] STAIR LIFT

[76] Inventor: Bogha S. Virk, 135 Thicketwood Drive, Scarborough, Ontario M1J 2A2, Canada

[21] Appl. No.: 888,797

[22] Filed: May 27, 1992

[51] Int. Cl.[5] ..... B66B 9/06

[52] U.S. Cl. ..... 187/12; 198/321

[58] Field of Search ..... 187/12, 17; 414/921; 198/321, 797, 678.1

[56] References Cited

U.S. PATENT DOCUMENTS

| | | | |
|---|---|---|---|
| 2,824,623 | 2/1958 | Nord et al. | 187/12 |
| 3,833,092 | 9/1974 | Flinchbaugh | 187/12 |
| 3,966,022 | 6/1976 | Cheney | 187/12 |
| 4,046,226 | 9/1977 | Flinchbaugh | 187/12 |
| 4,050,546 | 9/1977 | Wilson, Jr. | 187/12 |
| 4,179,012 | 12/1979 | Heberle | 187/12 |
| 4,354,575 | 10/1982 | Andersson | 187/12 |
| 4,627,517 | 12/1986 | Bor | 187/12 |
| 5,052,521 | 10/1991 | Wendt et al. | 187/12 |

FOREIGN PATENT DOCUMENTS

| | | |
|---|---|---|
| 1084861 | 9/1980 | Canada . |
| 1138366 | 12/1982 | Canada . |

*Primary Examiner*—Robert P. Olszewski
*Assistant Examiner*—Kenneth Noland
*Attorney, Agent, or Firm*—Ridout & Maybee

[57] ABSTRACT

A motor driven stair lift device is driven along the tubular track filled with transmission elements comprising incompressible spheres driven by a worm. Drive spheres affixed to a carrier and disposed in a portion of the track are driven with the transmission elements, causing movement of the carrier along the track.

13 Claims, 2 Drawing Sheets

STAIR LIFT

FIELD OF THE INVENTION

This invention relates to a motor-driven stair lift. In particular, this invention relates to a motor-driven stair lift utilizing spherical members encased in a tubular track as a drive chain.

BACKGROUND OF THE INVENTION

Motor-driven stair lift devices are commonly used to assist the physically handicapped in traversing a staircase. A conventional stair lift comprises a carrier or platform depending from a track mounted on a wall or side of the staircase. The platform is secured to a chain actuated by a motor-driven sprocket to drive the carrier up and down the staircase.

Significant disadvantages are inherent in such a device. Primarily, the inflexibility of a chain renders it difficult to install such a device around corners, such as where the staircase includes a landing. Furthermore, complex and expensive means must be utilized to prevent the carrier from free-falling in the event of a power interruption or breakage of the chain or drive mechanism.

Attempts have been made to overcome the problem of cornering by using a series of flexibly linked elements encased in a track, such as described in U.S. Pat. No. 4,627,517. Such a system is still subject to the danger of free-fall resulting from power outage or breakage or malfunction in the drive mechanism. Replacement of individual transmission elements can be difficult because of the manner in which they are connected. Moreover, as each individual transmission element is not free rolling, unnecessary wear occurs due to frictional resistance of the tubular casing.

The present invention overcomes these disadvantages by providing a stair lift utilizing a series of unconnected free rolling spheres abutting one another in a tubular track. The spheres are driven by a worm, whose axis is oriented parallel to the axis of the track, thus minimizing opportunity for breakage of the drive shaft and in any event providing an automatic safeguard against free-fall. In the event of power interruption or breakage of the motor or drive shaft, the worm stops revolving and acts as an abutment preventing movement of spheres within the track.

The advantages of cornering are easily obtained in such a system, and a broken or damaged sphere can be removed and replaced easily, since adjacent spheres do not interlock or interconnect in any fashion. Much wear and tear on the spheres is reduced because they are free rolling, thus enabling each individual sphere to roll against the direction of greatest friction.

SUMMARY OF THE INVENTION

The present invention thus provides a stair lift for traversing a staircase comprising a tubular track having a slotted portion substantially the length of the staircase and a portion parallel thereto, a carrier movably supported on the parallel portion of the track and attached to drive spheres residing in the slotted portion of the track, transmission elements comprising spheres sufficient in number to form, when abutting one another, a drive train substantially the length of the slotted portion of the track, and drive means including a worm cooperating with the spheres to displace the spheres in a selected direction to cause the carrier to ascend or descend along the track.

BRIEF DESCRIPTION OF THE DRAWINGS

In drawings which illustrate by way of example only a preferred embodiment of the invention.

DETAILED DESCRIPTION OF THE INVENTION

Figure 1:
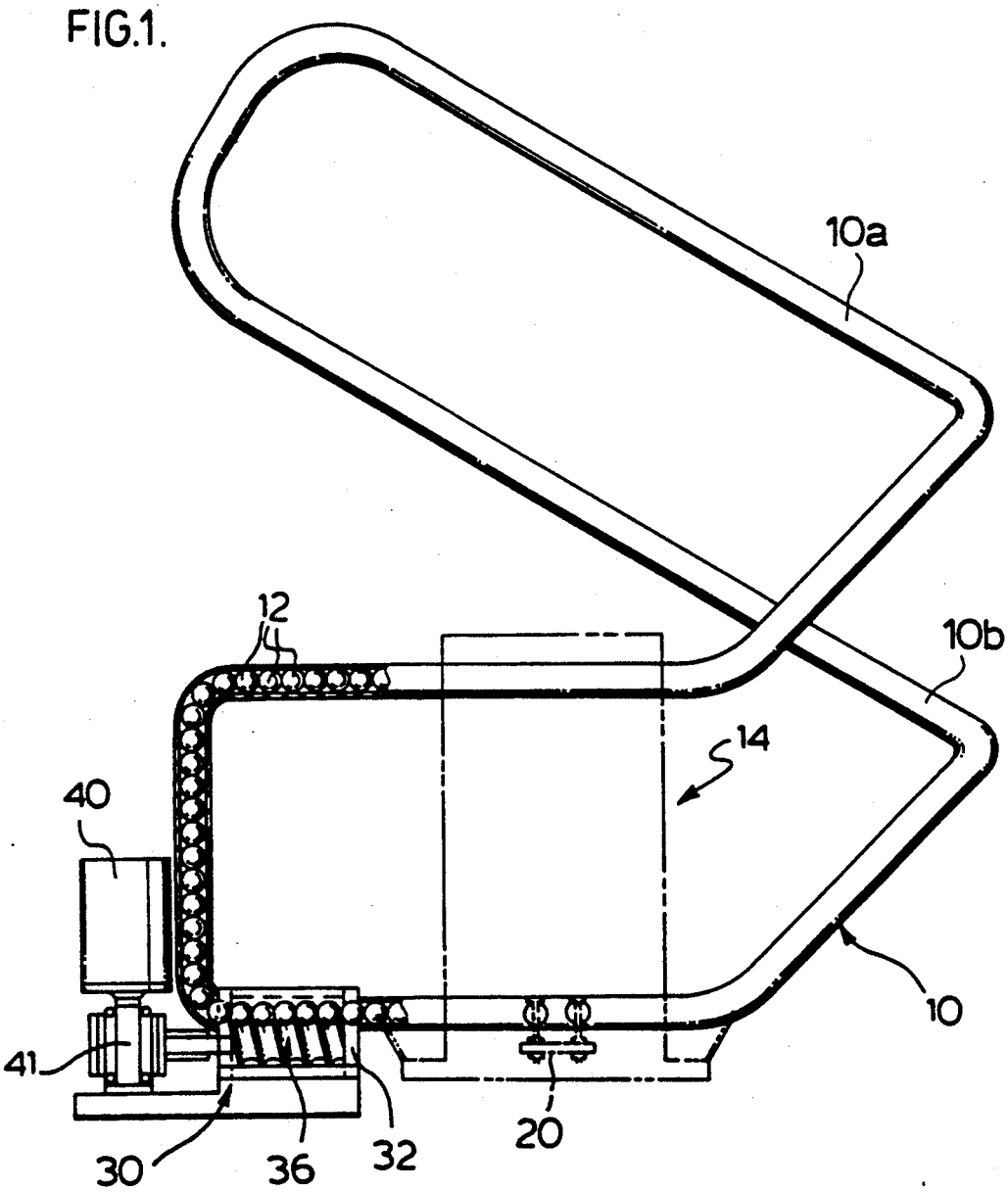
FIG. 1 is a side elevation, partially in section, of the present invention showing the carrier in phantom.

As illustrated in FIG. 1, a tubular track 10 preferably forms a closed ended loop comprising an upper portion 10*a* and a lower portion 10*b* arranged generally parallel to the staircase and affixed to a wall or side thereof. The track 10, preferably composed of steel or a similar sturdy material, encases a series of transmission elements comprising abutting spheres 12 which are preferably not joined or connected to one another. The spheres 12 are preferably composed of steel or other hard, incompressible material, with the result that movement of any individual sphere 12 along the track will cause displacement of all other spheres 12 commensurately. The diameter of the spheres 12 should be slightly less than the interior diameter of the tubular track 10.

Figure 3:
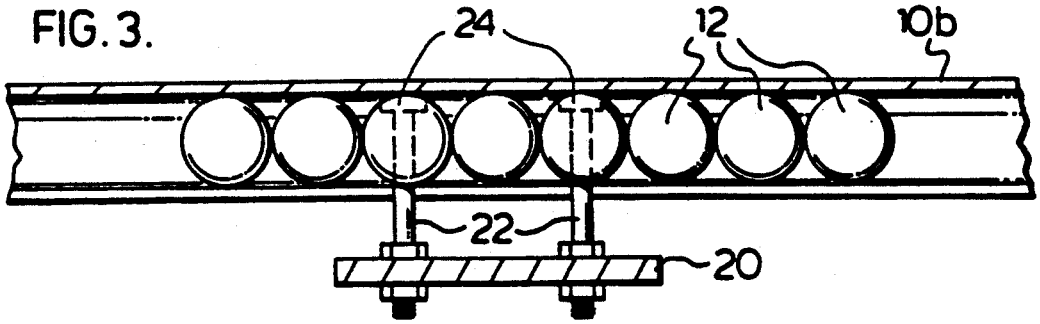
FIG. 3 is a sectional view of a portion of the track showing the drive spheres and supporting bracket.
Figure 2:
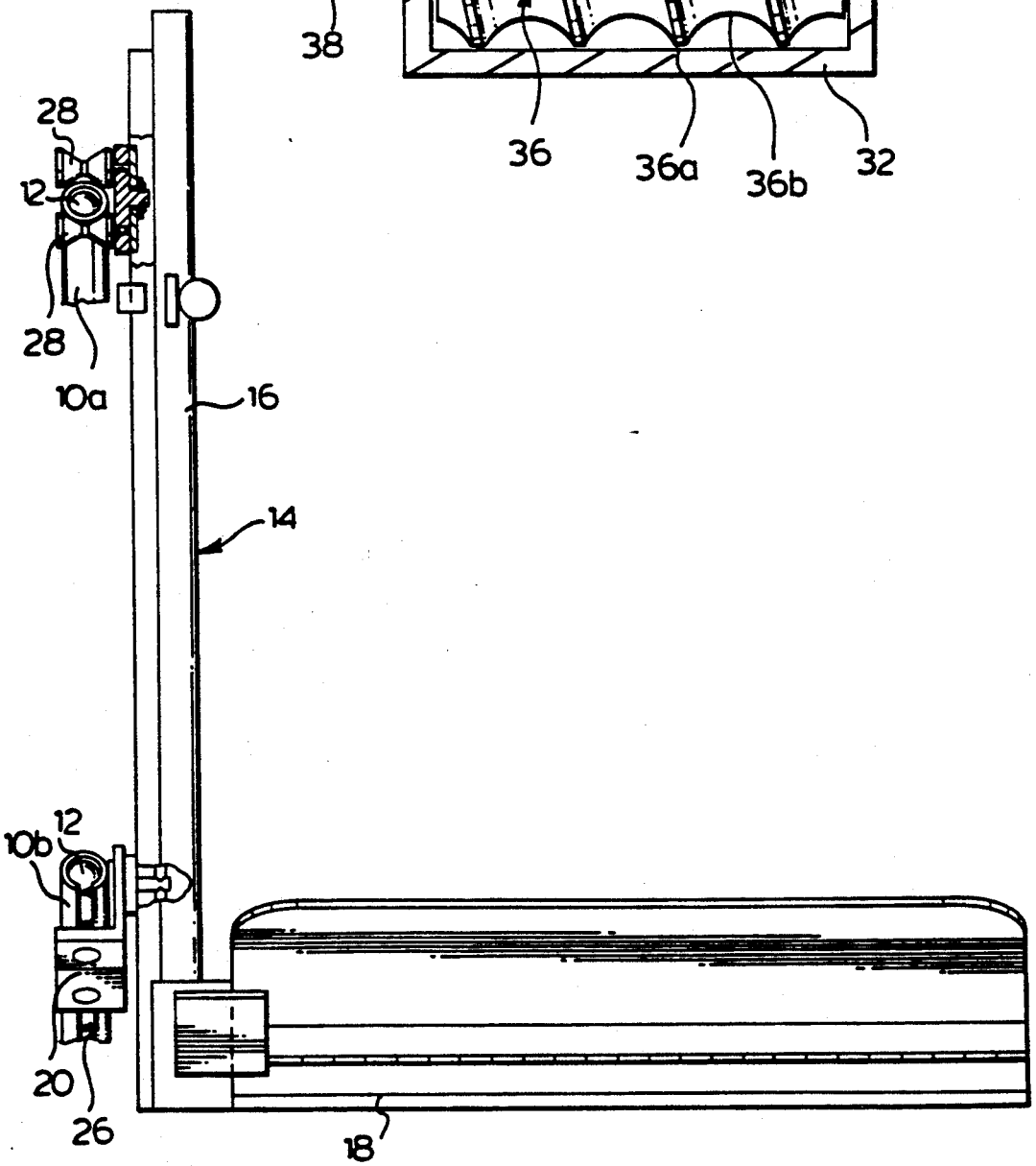
FIG. 2 is a side elevation of the carrier illustrated in phantom in FIG. 1.

A carrier 14, illustrated in FIG. 2, comprises an upright support structure 16 and a horizontal platform 18 with ramps 20 that can be raised and lowered in known fashion for safe transport of the user. A supporting bracket 20 is pivotally attached to the support structure 14 and supports bolts or posts 22 to which are secured at the top drive spheres 24 of a size comparable to the free rolling spheres 12 in the track. The bolts 22 may be disposed through the drive spheres 24 with the head of the bolts 22 countersunk into the drive spheres 24 to provide strong support while maintaining the spherical configuration, as illustrated in FIG. 3.

A slot 26 is provided along the bottom of the lower portion 10*b* of the track 10, substantially the length of the staircase, permitting the drive spheres 24 to reside in the track while the bolts 22 extend through the slot 26 to the supporting bracket 20. The carrier 14 is movably supported on the upper portion 10*a* of the track 10 by opposed rollers 28 of concave configuration, also pivotally attached to the carrier to yield to the slope of the track 10.

It is preferable to support the carrier 14 by rollers 28 on the upper portion 10*a* of the track 10, although it is also possible to support the carrier 14 on the lower portion 10*b* of the track 10 by rollers 28 and provide the slot 26 and the drive spheres 24 in the upper portion 10*a*. In either case, the drive spheres 24 should be relatively closely spaced, as should the supporting rollers 28, to permit the carrier to traverse corners in the track 10. A single drive sphere 24 may be sufficient, but a pair of drive spheres 24 is preferred for greater strength and safety.

A drive mechanism 30 is preferably located adjacent to the lowest corner of the track 10, although it may be located anywhere along the track 10 that will not interfere with movement of the carrier 14. The drive mechanism 30 includes a housing 32 having a bore 34 contiguous with the tubular track 10 and having a comparable interior diameter. A worm 36 is attached to a drive shaft 38 with its axis parallel to the axis of the track 10, and is driven through gear reducer 41 by a suitable motor 40 activated by a control switch (not shown) affixed to an easily accessible location on the carrier 14.

Figure 4:
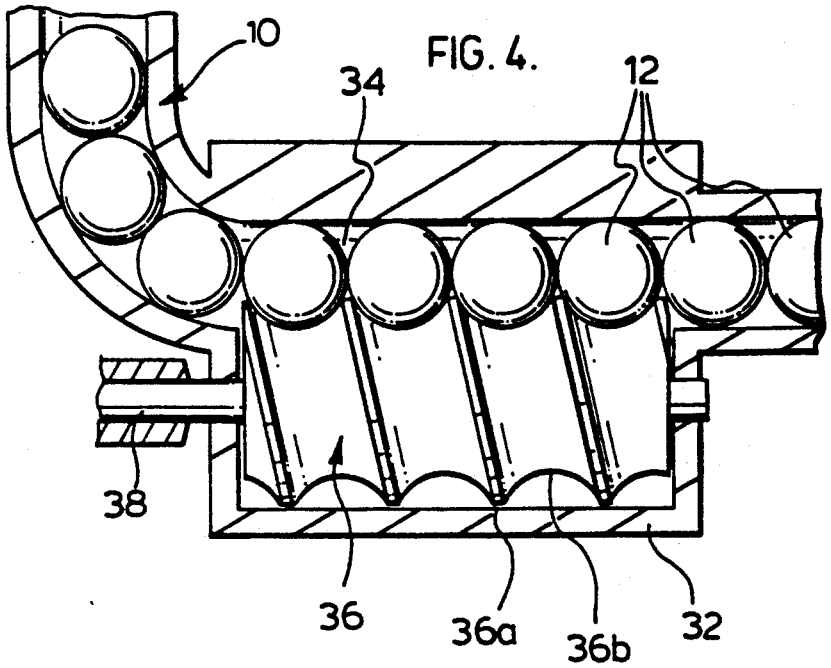
FIG. 4 is a sectional view of the worm drive illustrated in FIG. 1.

The worm 36 is preferably composed of steel or other sturdy material, and has a helical thread 36*a* tapering toward the axis of the worm 36 to form a helical curved channel 36*b* approximating the curvature of the spheres 12, as illustrated in FIG. 4. The spherical shape of the transmission elements 12 is readily accommodated by a worm 36 of this configuration. The helical channel 36*b* formed in the worm 36 preferably has a depth approaching the radius of the spheres 12, resulting in substantial engagement of the spheres 12 in the curved channel 36*b*. The bottom of the channel 36*b* coincides with the bottom of the interior of the tubular track 10, so that the spheres make a smooth transition between the track 10 and the bore 34.

In operation, the user secures himself or herself to the platform 18 in known fashion, and activates the motor 40 for the desired direction. The motor 40 drives the worm 36 which revolves and advances successive spheres 12 in the desired direction of motion. The drive spheres 24 are driven in the direction of motion, along with all other spheres 12 contained within the track, thus causing the carrier 14 to move in the desired direction along to track 10 to ascend or descend along the staircase.

It will be seen that a reasonable speed can be attained with minimal gear down, since the worm 36 combines with the spheres 12 to form in effect a worm gear which has a significant gear down ratio relative to the motor. Each revolution of the worm 36 advances the drive train by a single sphere 12.

It will also be seen that, in the event of a power interruption or breakage of any portion of the drive mechanism 30, the worm 36 ceases revolving but remains stationed within the housing 32. The thread 36*a* projects into the bore 34 and thus acts as an abutment to prevent downward displacement of the spheres 12 with resulting free-fall of the carrier 14. Since the drive shaft 38 is subjected to torsional stresses only, breakage is less likely. The force of the drive train operates longitudinally against the shaft 38, rather than circumferentially as in the case of a sprocket.

It will be apparent that, although preferable, it is not necessary to completely fill the track 10 with spheres 12. It is only necessary that there be a sufficient number of spheres 12 in the track 10 to form a drive train extending over the entire lower portion 10*b* of the track 10, i.e. the length of the staircase, so that the carrier 14 may be driven to its uppermost position. As the carrier 14 descends along the track 10, the spheres 12 are displaced toward the upper portion 10*a* of the track 10, as illustrated in section in FIG. 1, where they are essentially stored for use in driving the carrier 14 back up the track 10. In this embodiment, all sections of the upper portion 10*a* must be mounted on at least some incline, so that as the carrier 14 is driven up the track 10 the spheres 12 which are stored in the upper portion 10*a* of the track will free-fall toward the worm 36. Similarly, the carrier 14 is not driven down the track 10 per se, but rather falls down the track 10 at a rate determined by the rate of displacement of spheres 12 into the upper portion 10*a* of the track 10. If it is necessary that any significant length of the track 10 be oriented horizontally, it will be necessary to completely fill the track 10 with spheres 12 so that the drive train forms a closed loop and the carrier 14 is compressively driven along the track 10 in each direction by the worm 36. It will be readily apparent that the stair lift of the subject invention can thus accommodate virtually any combination of horizontal, vertical and sloped portions of track 10.

Having thus described by way of example a preferred embodiment of the present invention, it will be obvious to those skilled in the art that certain amendments and modifications of the invention may be made to adapt it to various applications. This invention includes all such modifications and amendments as followed in the scope of the appended claims.

I claim:

1. A stair lift for traversing a staircase comprising:
   a tubular track having a slotted portion substantially the length of the staircase and a portion parallel thereto,
   a carrier movably supported on the parallel portion of the track and attached to free rolling drive spheres residing in the slotted portion of the track,
   transmission elements comprising spheres sufficient in number to form, when abutting one another, a drive train substantially the length of the slotted portion of the track, and
   drive means including a worm co-operating with the spheres to displace the spheres in a selected direction to cause the carrier to ascend or descend along the track.

2. A stair lift as defined in claim 1 in which the slotted portion is a lower portion of the track.

3. A stair lift as defined in claim 1 in which the track is a closed loop and is completely filled with spheres.

4. A stair lift as defined in claim 2 wherein the carrier is movably supported on the parallel portion of the track by opposed rollers of concave configuration.

5. A stair lift as defined in claim 1 in which the track includes a vertical portion.

6. A stair lift as defined in claim 1 in which the track includes a horizontal portion.

7. A stair lift as defined in claim 1 in which the rack includes a sloped portion.

8. A stair lift as defined in claim 5 in which the track includes a sloped portion.

9. A stair lift as defined in claim 6 in which the track includes a sloped portion.

10. Transmission means for moving a carrier along a track, comprising a tubular track having a slotted portion, a carrier attached to free rolling drive spheres residing in the slotted portion of the track,
   transmission elements comprising spheres, abutting the drive spheres,
   drive means including a worm co-operating with the spheres to displace the spheres in a selected direction along the track, and
   means for storing transmission elements connected to the track, whereby the means for storing the transmission elements is disposed at a height greater than the height of the worm.

11. Transmission means for moving a carrier along a track, comprising:
   a tubular track having a slotted portion and configured in a loop to form an endless track,
   a carrier located outside the track attached to at least one drive sphere residing in the slotted portion of the track, transmission elements comprising spheres sufficient in number to form, when abutting one another, a drive train substantially the length of the track, and drive means including a worm co-operating with the spheres to displace the spheres in a selected direction to cause the carrier to move along the track.

12. Transmission means as defined in claim 11 wherein the carrier is attached to more than one drive sphere.

13. Transmission means as defined in claim 11 in which the spheres are free rolling.

* * * * *